US008388828B2

(12) United States Patent
Elomari et al.

(10) Patent No.: US 8,388,828 B2
(45) Date of Patent: Mar. 5, 2013

(54) RECOVERY AND USE OF CONJUNCT POLYMERS FROM IONIC LIQUID CATALYSTS

(75) Inventors: Saleh A. Elomari, Fairfield, CA (US); Hye-Kyung C. Timken, Albany, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 13/347,648

(22) Filed: Jan. 10, 2012

(65) Prior Publication Data

US 2012/0108862 A1 May 3, 2012

Related U.S. Application Data

(63) Continuation of application No. 12/336,298, filed on Dec. 16, 2008, now abandoned.

(51) Int. Cl.
*C07C 7/00* (2006.01)
*C07C 7/10* (2006.01)
*C07C 13/00* (2006.01)

(52) U.S. Cl. ..... 208/15; 585/17; 585/800; 585/809; 585/833

(58) Field of Classification Search ..... 208/15, 208/143; 585/17, 800, 809, 833
See application file for complete search history.

(56) References Cited

U.S. PATENT DOCUMENTS

| | | | | |
|---|---|---|---|---|
| 5,382,746 | A | 1/1995 | Child et al. | |
| 6,395,945 | B1 * | 5/2002 | Randolph | 585/332 |
| 6,413,897 | B1 * | 7/2002 | Randolph et al. | 502/31 |
| 7,732,364 | B2 * | 6/2010 | Chang et al. | 502/53 |
| 7,737,067 | B2 * | 6/2010 | Elomari et al. | 502/28 |
| 7,807,597 | B2 * | 10/2010 | Elomari et al. | 502/53 |
| 7,884,045 | B2 * | 2/2011 | Harris et al. | 502/150 |
| 7,955,999 | B2 * | 6/2011 | Luo et al. | 502/22 |
| 2007/0142211 | A1 | 6/2007 | Elomari et al. | |
| 2007/0142213 | A1 * | 6/2007 | Elomari et al. | 502/53 |
| 2007/0142214 | A1 | 6/2007 | Elomari et al. | |
| 2007/0142215 | A1 | 6/2007 | Harris et al. | |
| 2007/0142216 | A1 | 6/2007 | Harris et al. | |
| 2007/0142217 | A1 | 6/2007 | Elomari et al. | |
| 2007/0142218 | A1 | 6/2007 | Harris et al. | |
| 2007/0249485 | A1 | 10/2007 | Elomari et al. | |
| 2007/0249486 | A1 | 10/2007 | Elomari et al. | |
| 2008/0087574 | A1 | 4/2008 | Gaffney | |
| 2009/0054713 | A1 * | 2/2009 | Matkovsky et al. | 585/326 |

OTHER PUBLICATIONS

Miron et al., Molecular Structure of Conjunct Polymers, Journal of Chemical & Engineering Data, Jan. 1963, pp. 150-160, vol. 8 No. 1. ACS Publications, Washington, USA.

Pines, Saga of a Discovery: Alkylation, Chemtech, Mar. 1982, pp. 150-154.

* cited by examiner

*Primary Examiner* — Ellen McAvoy
(74) *Attorney, Agent, or Firm* — Steven H. Roth

(57) ABSTRACT

A process comprising regenerating a used ionic liquid catalyst, recovering conjunct polymer from the regenerated catalyst and using at least a portion of the conjunct polymer is disclosed.

6 Claims, No Drawings

RECOVERY AND USE OF CONJUNCT POLYMERS FROM IONIC LIQUID CATALYSTS

FIELD OF THE INVENTION

The present invention relates to methods of recovery and use of conjunct polymers derived from the use of ionic liquid catalysts. It also relates to new hydrocarbon product compositions comprising conjunct polymers.

BACKGROUND OF THE INVENTION

Conjunct polymers are common by-products of acid-catalyzed alkylation reactions including the alkylations of isoparaffins, e.g. isobutane and isopentane, with light olefins, e.g. propylene and butenes, to produce high octane and clean burning alkylate gasoline. The term conjunct polymer was first used by Pines and Ipatieff to distinguish these polymeric molecules from typical polymers. Unlike typical polymers which are compounds formed from repeating unites of smaller molecules by controlled or semi-controlled polymerizations, "conjunct polymers" are "pseudo-polymeric" compounds formed asymmetrically from two or more reacting units by concurrent acid-catalyzed transformations including polymerization, alkylation, cyclization, additions, eliminations and hydride transfer reactions. Consequently, the produced "pseudo-polymeric" may include a large number of compounds with varying structures and substitution patterns. The skeletal structures of "conjunct polymers", therefore, range from the very simple linear molecules to very complex multi-feature molecules.

Some examples of the likely polymeric species were reported by Miron et al. (*Journal of Chemical and Engineering Data,* 1963) and Pines (*Chem. Tech,* 1982). Conjunct polymers are also commonly known to those in the refining industry as "red oils" due to their reddish-amber color or "acid-soluble oils" due to their high uptake in the catalyst phase where paraffinic products and hydrocarbons with low olefinicity and low functional groups are usually immiscible in the catalyst phase. In this application, the term "conjunct polymers" also includes ASOs (acid-soluble-oils) red oils and $C_{12}$+ polyalkylates.

Separating conjunct polymers formed as by-products during HF-catalyzed isoparaffin/olefin alkylation from the catalyst-alkylation products-conjunct polymer mixture has been described in U.S. Pat. No. 5,382,746.

SUMMARY OF THE INVENTION

The present invention relates to a process comprising regenerating a used ionic liquid catalyst, recovering conjunct polymer from the regenerated catalyst and using at least a portion of the conjunct polymer.

DETAILED DESCRIPTION

Conjunct polymers formation is inevitable during alkylation reactions of isoparaffins with olefins to make alkylate gasoline. The formation of conjunct polymers during alkylations is undesirable because conjunct polymers negatively affect the overall alkylation process in many ways. They affect the yield of the desired reactions and adversely influence the course of the intended transformations. The most significant effect of "conjunct polymers" is the role they play in the deactivation process of the catalyst.

In the alkylation processes catalyzed by sulfuric or hydrofluoric acid, conjunct polymers play a major role in the deactivation process leaving the catalyst ineffective for alkylation at conjunct polymers concentration of higher than 10-15 wt %. Conjunct polymers also deactivate other alkylation catalysts, including solid acid alkylation catalysts. See US 20080087574A2. In sulfuric acid-catalyzed processes, the conjunct polymers are inseparable from the acid phase and very difficult to isolate. The spent acid streams of sulfuric acid alkylation processes containing conjunct polymers are usually incinerated to recover sulfuric acid in the form of sulfur oxides while the hydrocarbon by-products (conjunct polymers) are burnt off. For HF alkylation, used HF acid is heated at an elevated temperature to thermally crack the polymer to recover HF and hydrocarbon. Stripping of light hydrocarbon and HF in the regenerator produces a complex mixture of conjunct polymers containing heavy organic fluoride and HF. Due to toxicity of HF and corrosivity of HF containing conjunct polymer, the polymer is often incinerated.

Conjunct polymer formation similarly affects the performance of ionic liquid catalysts. Unlike conjunct polymers formed using HF and sulfuric acid catalysts, conjunct polymers produced in ionic liquid alkylations are recoverable from the catalyst phase with no residual acid contaminants and can be readily sent to processing units in the refinery to be processed into lighter or more usable cuts. This desirable feature of the recoverability of the ionic liquids-based conjunct polymers derives from the regenerability of the ionic liquid catalyst which is lacking in sulfuric acid alkylation and more difficult in the HF-based alkylation. In an embodiment, conjunct polymers are recovered from ionic liquid catalyst through the catalyst regeneration process.

Ionic liquids can be defined as liquids whose make-up is entirely comprised of ions as a combination of cations and anions. The most common ionic liquids are those prepared from organic-based cations and inorganic or organic anions. The most common organic cations are ammonium cations, but phosphonium and sulphonium cations are also frequently used. Ionic liquids of pyridinium and imidazolium are perhaps the most commonly used cations. Anions include, but not limited to, $BE_4^-$, $PF_6^-$, haloaluminates such as $Al_2Cl_7^-$ and $Al_2Br_7^-$, $[(CF_3SO_2)_2N]^-$, alkyl sulphates ($RSO_3^-$), carboxylates ($RCO_2^-$) and many other. The most catalytically interesting ionic liquids for acid catalysis are those derived from ammonium halides and Lewis acids (such as $AlCl_3$, $TiCl_4$, $SnCl_4$, $FeCl_3$). Chloroaluminate ionic liquids may be the most commonly used ionic liquid catalyst systems for acid-catalyzed reactions, such as alkylations.

Ionic liquids may be suitable for use as catalysts and solvents for a number of transformations including, among others, alkylation, polymerization, dimerization, oligomerization, acylation, metatheses, copolymerization, isomerization, hydrogenation, hydroformylation reactions and combinations thereof.

In one embodiment, conjunct polymer is recovered in a process for isoparaffins-olefins alkylation using butyl pyridinium chloroaluminate-based ionic liquid catalyst co-catalyzed with HCl or t-butyl chloride to produce alkylate gasoline. During the alkylation process, conjunct polymers are produced. Conjunct polymers play a major role in the deactivation processes of the ionic liquid catalyst. In an embodiment, conjunct polymers are recovered during regeneration of the ionic liquid catalyst.

Regeneration of the ionic liquid catalyst for conjunct polymer recovery may be conducted by any method which frees conjunct polymer from the catalyst. Exemplary suitable methods are disclosed in U.S. Patent Applications 20070249486; 20070249485; 20070142211; 20070142213; 20070142214; 20070142215; 20070142216; 20070142217; and 20070142218, which are incorporated by reference herein.

Conjunct polymers can be recovered and extracted from the spent catalyst by means of hydrolysis. The hydrolysis recovery methods employ procedures that lead to complete recovery of the conjunct polymers and are generally used for analytical and characterization purposes because it results in the destruction of the catalyst. Hydrolysis of the spent catalyst is done, for example, by stirring the spent catalyst in the presence of excess amount of water followed by extraction with low boiling hydrocarbon solvents such as pentane or hexane. In the hydrolysis process, the catalyst salt and other salts formed during hydrolysis go into the aqueous layer while conjunct polymers go into the organic solvent. The low boiling solvent containing the conjunct polymers are concentrated on a rotary evaporator under vacuum and moderate temperature to remove the extractant, leaving behind the high boiling residual oils (conjunct polymers) which are collected and analyzed. The low boiling extractants can be also removed by distillation methods.

Generally, conjunct polymers recovered by hydrolysis of a butyl pyridinium chloroaluminate-based ionic liquid catalyst used in a process for isoparaffins-olefins alkylation are viscous brown odorous hydrocarbons. They are highly unsaturated molecules containing both cyclic and acyclic features. They contain about ppm-0.8% chlorides, and may contain up to few hundreds ppm level of sulfur (coming from the sulfur impurities in the feed). They have a boiling range of about 177° C. (350° F.) to about 593° C. (1100° F.) and a carbon number range of about C9 to about mid C30s. Regeneration-based conjunct polymers, recovered from a butyl pyridinium chloroaluminate-based ionic liquid catalyst used in a process for isoparaffins-olefins alkylation, contain high degree of unsaturation, but are less viscous, less odorous, and lighter in color than hydrolysis conjunct polymers. They exhibit a boiling range of about 350° F. to about 1100° F. and a carbon distribution of about C9 to about C30s. In an embodiment, conjunct polymers are upgraded and refined to more useful products by sending them to refining/processing units.

Unlike the current alkylation processes catalyzed by HF or $H_2SO_4$, ionic liquid catalysts can be regenerated in such a way that the conjunct polymers are easily extracted and recovered from the catalyst phase, and recycled to the refinery.

Conjunct polymers obtained from the regenerated catalyst are, in general, less viscous than conjunct polymers-by-hydrolysis and lighter in color. Their color ranges from faint yellow to light orange. When Al/HCl or Al—Ni alloy/hydrogen, are used for the regeneration, the recovered conjunct polymers are even lighter and, usually, colorless.

Unlike the current alkylation technologies catalyzed by sulfuric or hydrofluoric acid, conjunct polymers produced by ionic liquids-based catalysis are recoverable by benefit of the catalyst regeneration, and can be used in many ways. The conjunct polymers recovered from regeneration of ionic liquid catalysts can be readily sent to processing units in the refinery to be processed into lighter cuts. In an embodiment, conjunct polymers can be recovered from ionic liquid catalyst through the catalyst regeneration process. In an embodiment, the recovered hydrocarbons exhibit a boiling range (simulated distillation analysis) of upper 300-1000° F. The liberated conjunct polymers do exhibit a higher viscosity than those desired for diesel fuel stocks. They have a VI (viscosity Index) of ~24 and a Kinematic Viscosity of 10.3 $mm^2/s$@ 40° C. and 2.8 $mm^2/s$@ 100° C. Hydrolysis conjunct polymers and regeneration conjunct polymers that are derived from ionic liquids-based alkylation can be readily upgraded. The properties of the conjunct polymers recovered by regeneration, however, are much more attractive than those of conjunct polymers recovered from unregenerated spent catalyst streams which are more viscous and richer in organic chlorides. Table 1 shows some comparison between the hydrolysis-derived and regeneration-derived conjunct polymers.

TABLE 1

| Conjunct polymers | K. Vis. @ 40° C. | K. Vis. @ 100° C. | Color |
|---|---|---|---|
| Hydrolysis CPs | 26 $mm^2/s$ | 3.8 $mm^2/s$ | Dark Brown |
| Regeneration CPs | 10.31 $mm^2/s$ | 2.4 $mm^2/s$ | Yellow-brown |

The conjunct polymers recovered from ionic liquid alkylations can be readily de-chlorinated and de-sulfurized by known processes in the art to transform them into more suitable feeds for the appropriate refining or processing units. In an embodiment, these conjunct polymers are treated to remove any impurities especially chloride impurities to render them suitable for introduction into a hydrocracker or other processing unit that may be very sensitive to chlorides. These conjunct polymers in some embodiments after dechlorination and desulfurization may be fed into a hydrocracker, hydrotreater, FCC unit, coker or a crude oil unit where they can be processed into more useful products or lighter cuts. Therefore, unlike the $H_2SO_4$ or HF-catalyzed alkylation processes where the alkylation by-products are treated as waste, or may require extensive clean up and pretreatment processing, the ionic liquid-derived conjunct polymers, regardless of the recovery method, are much cleaner than those of other alkylation technologies and require much less rigorous upgrading processes. The ionic liquids-based conjunct polymers can be readily converted into high quality light products with minimal pretreatment. So in an embodiment in which an ionic liquid catalyst is used for low molecular weight isoparaffin olefin alkylation, the process is expanded from a process in which low molecular weight gases are converted to high quality alkylate gasoline to a process in which low molecular weight gases are converted to high quality alkylate gasoline and in which heavier byproducts can be recycled and processed into useful products. In essence, this embodiment is a process where low value gases are converted to valued liquid products without hydrocarbon losses. By the same token, the regeneration aspect of this embodiment is not solely a catalyst regeneration process to reactivate the catalyst, but also an efficient procedure for pre-treating and recovering hydrocarbon by-products which otherwise go to the waste stream.

Hydrotreating using a hydrogenation catalyst or hot caustic treating is effective in lowering the S and Cl content. Suitable hydrotreating catalysts include Group VI and VIII metals and combinations dispersed on porous high surface area supports. Examples are palladium on carbon, a nickel-aluminum alloy, palladium on alumina, NiMo on alumina, CoMo on alumina catalyst, or NiW on alumina. For caustic treating, Group I and Group II metal hydroxide solutions will be effective such as NaOH, KOH, CsOH, RbOH, $Mg(OH)_2$, $Ba(OH)_2$.

Recovered conjunct polymers can be used in the production of hydrocarbon products such as fuels and lubricants. More specifically, recovered conjunct polymers may be used to produce diesel fuel, jet fuel and high energy fuels. Rather than sending recovered conjunct polymers to a refinery processing unit, they can be simply treated by procedures known in the art to remove any residual alkyl chlorides and sulfur-based impurities to upgrade them to more useful products. For example, these conjunct polymers can be hydrotreated according to procedures known in the art to be de-chlorinated, saturated and de-sulfurized to produce clean middle distillate fuels and diesel. Fractionation of conjunct polymers recovered from regenerated catalyst by distillation yielded up to 69% jet fuels with smoke point of 37 and extremely freezing point, 25% diesel fuels with Cetane Index of 58 and no cloud point, and 6% residue suitable for the FCC unit. These conjunct polymeric species do contain cyclic systems and extensive branching that they may be used as high energy fuels. Both the jet fuel fraction and the diesel fuel fraction exhibit high Gravimetric Net Heat of combustion at 18880 KBTU/lb and 18661 KTBU/lb, respectively.

The following Examples are illustrative of the present invention, but are not intended to limit the invention in any way beyond what is contained in the claims which follow.

Example 1

This Example describes a methods used to regenerate catalyst and remove conjunct polymers from the catalyst by treating the spent catalyst with aluminum metal at moderate temperatures. Spent catalyst is heated to 100° C., and then allowed to stir in the presence of aluminum for a given period of time ranging from 30-120 minutes. The reaction is normally done in the presence of an inert hydrocarbon solvent such as normal paraffins, such as n-hexane, to act as solvents and carriers for the liberated conjunct polymers. The addition of hydrocarbon solvents is sometimes delayed until after the aluminum treatment. Once the reaction between the spent catalyst containing conjunct polymers and aluminum is done, the hydrocarbon (solvent) layer, which contains the liberated conjunct polymer, is decanted off. The catalyst is usually rinsed with additional amount of solvent to extract all recoverable conjunct polymers from the catalyst phase. The solvent extracts are concentrated under vacuum and moderate temperatures to remove the solvent. The residual oils (liberated conjunct polymers) are collected and analyzed.

The recovered conjunct polymers have a flash point of about 64° C. and a density of about 0.87 gm/cc at 15° C. On the average, conjunct polymers have a specific gravity of about 0.84. The conjunct polymers have a boiling range in the range from about 350 to about 1200 deg F. The liberated conjunct polymers do exhibit a VI (viscosity Index) of 24 and Kinematic Viscosity of 10.3 $mm^2/s$@ 40° C. and 2.4 $mm^2/s$@ 100° C.

TABLE 2

| Conjunct polymers | $Vis_{40° C.}$ | $Vis_{100° C.}$ | color |
|---|---|---|---|
| Hydrolysis CPs | 26 $mm^2/s$ | 3.8 $mm^2/s$ | Dark Brown |
| Regeneration CPs | 10.31 $mm^2/s$ | 2.4 $mm^2/s$ | Yellow-brown |

Example 2

Hydrotreating of Conjunct Polymers

A 300 cc autoclave was charged with 168 gm of conjunct polymers recovered from regenerated ionic liquid catalyst. The conjunct polymers contained 493 ppm chlorine (organic chlorides), 69 ppm sulfur and had a bromine number of 203. Then, 5-10 gm of hydrogenation catalyst was added to the conjunct polymers in the autoclave. The autoclave was then pressurized with hydrogen to 500 psi and heated to 200° C. and kept at 200° C. while being stirred for 2 hrs. The pressure was kept at 500 psi for the duration of the run. Then, the reactor was cooled down, de-pressurized and the contents were analyzed. The reaction was done repeatedly but with different hydrogenation catalyst each time. The table below shows the results as a function of the hydrogenation catalyst. The data in the table below shows that conjunct polymers can be readily upgraded to hydrocarbon with very minimal chloride and sulfur impurities where they can be used as feedstocks in some of the refining operations such the hydrocracker diesel hydrotreater, coker, fluid catalytic cracker or the crude oil unit.

TABLE 3

| | $Br_2$# | Sulfur | Chloride |
|---|---|---|---|
| Starting material | 30 | 147 ppm | 361 ppm |
| 60% Ni on Kieselguhr | 28 | 22 ppm | 10 ppm |
| Pt/C[1] | 32 | 74 ppm | 8.8 ppm |
| Pd/C[2] | 27 | 86 ppm | 33 ppm |
| 1:1 $Pt_{/c}$ /$Pd_{/c}$ [3] | 28 | 81 ppm | 15.2 ppm |
| 66% Ni-Silica/Alumina | 14 | 9 ppm | 6 ppm |
| Pt/Pd-Silica/Alumina[4] | 172 ppm (203)* | 49 ppm (69)* | 21 ppm (493)* |

*the conjunct polymers for this run were from different lot and the values in ( ) are before treatment;
[1]1% Pd on carbon 4-8 mesh;
[2]1% Pt on carbon 30-150 mesh;
[3] a mixture of 1% Pd/C and 1% Pt/C;
[4]silica-alumina impregnated with Pt and Pd

Example 3

De-Chlorination of Conjunct Polymers by Hot Caustic Treatment

In 1-liter glass reaction flask equipped with a reflux condenser and an over-head stirrer, conjunct polymers recovered from the regenerated ionic liquid catalyst were refluxed (heated at reflux) in various aqueous KOH solutions for 2-3 hrs. Then, the reaction mixture was cooled to room temperature and the hydrocarbon was separated from the aqueous layer and dried over magnesium sulfate. The organic phase was then analyzed for chlorides and sulfur contents and for olefinicity by bromine number analysis. The table below compares the conjunct polymers before and after the KOH treatment at different KOH strengths.

TABLE 4

| | $Br_2$# | Sulfur | Chloride |
|---|---|---|---|
| Starting material | 30 | 147 ppm | 361 ppm |
| 1M KOH treatment | 33 | 132 ppm | 114 ppm |
| 2M KOH treatment | 32 | 108 ppm | 106 ppm |
| 3M KOH treatment | 61 (56)* | 196 (254)* ppm | 144 (370)* ppm |
| 5M KOH treatment | 32 | 100 | 116 ppm |

*the conjunct polymers for this run were from a different lot and the values in Parentheses are before treatment

Example 4

To de-chlorinate the conjunct polymers, they were treated with hot caustic by heating the conjunct polymers to reflux in an aqueous hydroxide ion solution. In an aspect, this aqueous hydroxide ion solution was 3M aqueous KOH solution. The reflux was carried out for 2-3 hours. The treatment resulted in 65% chloride reduction. The treatment with hot 3M KOH also resulted in some de-sulfurization of the conjunct polymers where sulfur levels dropped by ~23-33%. Table 5 below shows a comparison between the levels of chloride and sulfur before and after the hot caustic treatment. There was slight upward shift in the bromine number reflecting the elimination of hydrochloride which leads to making more double bonds.

TABLE 5

| | Run 1 | Run2 |
|---|---|---|
| Chloride before KOH | 370 | 351 |
| Chloride after KOH | 144 | 120 |
| Sulfur Before KOH | 254 | 143 |
| Sulfur after KOH | 196 | 95 |
| Bromine# before KOH | 58 | 30 |
| Bromine# after KOH | 62 | 33 |
| Color before KOH | Dark Amber | Dark amber |
| Color after KOH | Light Amber | Dark amber |

Example 5

Saturation of the Double Bonds of Conjunct Polymers

An alternative procedure that might affect the saturation of the double bonds of the conjunct polymers and de-chlorinate them is hydrotreatment with a hydrotreating catalyst. To achieve this, the conjunct polymers (75 gm) were heated at 200° C. and 500 psi $H_2$ pressure over hydro-processing catalyst (10 gm of alumina/silica-based hydroprocessing catalyst impregnated with 0.18% Pt and 0.36% Pd) for 2 hrs. The reaction was done in a 300 cc sealed autoclave (batch type reactor). The conjunct polymers were analyzed before and after the reaction. The data is summarized in table 1 below. Hydrotreating the conjunct polymers did not result in substantial reduction of the olefinicity of the conjunct polymers, but reduced the chloride content by ~95%. The sulfur content was also reduced by ~29%. Noticeably, the color of the conjunct polymers, however, changed to much lighter tint oils after the hydrotreatment. Reduction of the olefinicity of the conjunct polymers is not an issue of concern especially since these species will be used as feed stocks to processing units rather than end products. However, the removal of chloride and sulfur impurities is an issue depending on what processing unit these by-products will feed into.

TABLE 6

| | Run 1 | Run2 |
|---|---|---|
| Chloride before hydrotreatment | 493 ppm | 270 ppm |
| Chloride after hydrotreatment | 21 ppm | 15 ppm |
| Sulfur before hydrotreatment | 69 ppm | 143 ppm |
| Sulfur after hydrotreatment | 49 ppm | 71 ppm |
| $Br_2$# before hydrotreatment | 203 | 30 |
| $Br_2$# after hydrotreatment | 172 | 24 |
| Color before hydrotreatment | amber | yellow |
| Color after hydrotreatment | Light yellow | clear |

There are numerous variations on the present invention which are possible in light of the teachings and supporting examples described herein. It is therefore understood that within the scope of the following claims, the invention may be practiced otherwise than as specifically described or exemplified herein.

What is claimed is:

1. A process comprising regenerating a used ionic liquid catalyst, recovering conjunct polymer from the regenerated catalyst and using at least a portion of the recovered conjunct polymer as feedstock to a refinery process unit.

2. A process according to claim 1, wherein the refinery process unit is selected from the group consisting of a hydrocracker, a hydrotreater, a coker, a fluid catalytic cracker and a crude oil unit.

3. A process according to claim 1, further comprising dechlorinating the recovered conjunct polymer before using it as feedstock.

4. A process according to claim 1, further comprising desulfurizing the recovered conjunct polymer before using it as feedstock.

5. A process comprising regenerating a used ionic liquid catalyst, recovering conjunct polymer from the regenerated catalyst and processing at least a portion of the recovered conjunct polymer by a process selected from the group consisting of hydrotreating, hydrocracking, fluid catalytic cracking, crude oil distillation and coking to produce a hydrocarbon product.

6. A process according to claim 5, wherein the hydrocarbon product is a l selected from the group consisting of lubricants, high energy component distillate fuel, diesel fuel, jet fuel and gasoline.

* * * * *